US009901938B1

(12) United States Patent
Chang

(10) Patent No.: US 9,901,938 B1
(45) Date of Patent: Feb. 27, 2018

(54) WATER SPRAY NOZZLE

(71) Applicant: Cheng Yao Hardware Co., Ltd., Taichung (TW)

(72) Inventor: Chao-Ming Chang, Taichung (TW)

(73) Assignee: Cheng Yao Hardware Co., Ltd., Taichung (TW)

( * ) Notice: Subject to any disclaimer, the term of this patent is extended or adjusted under 35 U.S.C. 154(b) by 0 days.

(21) Appl. No.: 15/358,433

(22) Filed: Nov. 22, 2016

(51) Int. Cl.
*B05B 1/12* (2006.01)
*B05B 1/16* (2006.01)
*B05B 1/18* (2006.01)

(52) U.S. Cl.
CPC ..... *B05B 1/16* (2013.01); *B05B 1/185* (2013.01)

(58) Field of Classification Search
CPC .... B05B 1/12; B05B 1/14; B05B 1/16; B05B 1/1636; B05B 1/1645; B05B 1/1654; B05B 1/18; B05B 1/185
USPC ..... 239/443–449, 525, 526
See application file for complete search history.

(56) References Cited

U.S. PATENT DOCUMENTS 6,151,729 A 11/2000 Yean
7,819,340 B2 * 10/2010 Mueller ..... B05B 7/2443 239/310
8,550,380 B2 * 10/2013 Gautschi ..... B05B 1/083 239/447
2006/0016912 A1 * 1/2006 Nobili ..... B05B 1/1618 239/525
2008/0023576 A1 * 1/2008 Boesch ..... B05B 1/1618 239/446
2009/0200401 A1 * 8/2009 Esche ..... B05B 1/1618 239/525
2016/0160483 A1 * 6/2016 Wu ..... E03C 1/0405 137/625.28

* cited by examiner

*Primary Examiner* — Darren W Gorman
(74) *Attorney, Agent, or Firm* — Senniger Powers LLP

(57) ABSTRACT

A water spray nozzle comprises a switching rod that has a direction switching piece disposed at the end of a water outlet compartment and a preset quantity of slant protruded portions disposed around the direction switching piece. The nozzle also has a switching disk disposed on a bottom of the water outlet compartment around the switching rod between a guiding piece and the direction switching piece. Switching ribs having a preset quantity of slant switching protruded portions is disposed outside a switching hole near the direction switching piece for meshing with the slant protruded portions, and a plurality of switching water holes is disposed around a circumference of the switching disk. Switching water holes are disposed in a same radial direction so that they are selectively superimposed with specific water outlet holes.

3 Claims, 4 Drawing Sheets

WATER SPRAY NOZZLE

BACKGROUND

Aspects of the present invention relate to a water spray nozzle.

Conventional water spray nozzles have a switch disposed on its body. The letting out of water is controlled by the switch through a valve. Conventional water spray nozzles are switched on or off by the switch, which only has a single function. In order to make the water spray nozzle multi-functional, a switchable switch is disposed on the water spray nozzle for allowing different ways of water spraying as disclosed in U.S. Pat. No. 6,151,729.

SUMMARY

However, in conventional switchable switches, the position of a valve is changed by switching method. Thus, there are only two different directions, which are very limited. Furthermore, the switchable switch can be mistakenly pressed to change the way of outlet of water. Therefore, it is inconvenient in usage.

A water spray nozzle embodying aspects of the present invention comprises a handle body with a handle portion and a head portion, the handle portion having a water inlet hole and a water outlet hole. The nozzle includes a switch valve disposed between the water inlet hole and the water outlet hole, a water outlet compartment disposed in the head portion for connecting with the water outlet hole, an opening disposed at an end of the water outlet compartment, an axial hole disposed at another end opposite to the opening, the axial hole having a limitation groove disposed inside the water outlet compartment, and a preset quantity of limitation slots disposed axially and concavely inside the limitation groove. The nozzle also includes a switching rod disposed inside the axial hole, a central of the switching rod having a guiding piece slidably disposed in the limitation groove, guiding ribs disposed on a circumference of the guiding piece, a slant guiding surface disposed at an end of the guiding rib, the guiding ribs being axially limited inside the limitation slots, the switching rod having a direction switching piece disposed at the end of the water outlet compartment, and a preset quantity of slant protruded portions disposed around the direction switching piece. Further, the nozzle has a switching disk disposed on a bottom of the water outlet compartment, a switching hole penetrated through a center of the switching disk, the switching disk being disposed around the switching rod between the guiding piece and the direction switching piece, switching ribs protrudedly disposed inside the switching hole, the switching rib having a slant switching surface disposed near the guiding rib and opposite to the slant guiding surface, a preset quantity of slant switching protruded portions disposed outside the switching hole near the direction switching piece for meshing with the slant protruded portions, and a plurality of switching water holes disposed around a circumference of the switching disk. The nozzle further includes a water passage switching piece concavely disposed with a recess at a center, the recess being provided for accommodating the direction switching piece of the switching rod and the slant switching surface of the switching disk, a preset quantity of water outlet holes disposed around a circumference of the water passage switching piece, and the water outlet holes and the switching water holes being disposed in a same radial direction so that the switching water holes being selectively superimposed with the specific water outlet holes and includes two elastic support elements respectively disposed between the bottom of the water outlet compartment and the switching disk, and between the direction switching piece and the recess.

The water spray nozzle of the present disclosure can be switched on or off through the switch valve of the handle body. Simply press the switching rod for switching between the ways of usage. The guiding piece of the switching rod drives and rotates the switching disk. The positions of the switching water holes are changed by having the slant protruded portions to mesh with the slant switching protruded portions. After the positions are changed, the switching water holes can be superimposed with different water outlet holes for changing the way of outlet of water. It is easy to use and speedy for switching direction. The switching rod is disposed at the back of the head portion and therefore is ergonomically designed.

The present invention will become more fully understood by reference to the following detailed description thereof when read in conjunction with the attached drawings.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE INVENTION

Figure 1:
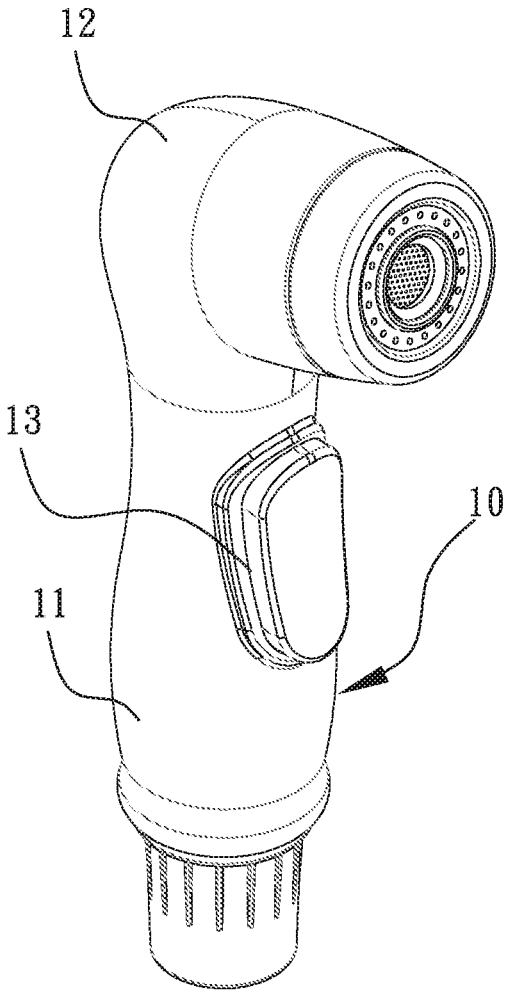
FIG. 1 is a perspective view of a preferred embodiment of a water spray nozzle of the present invention.
Figure 2:
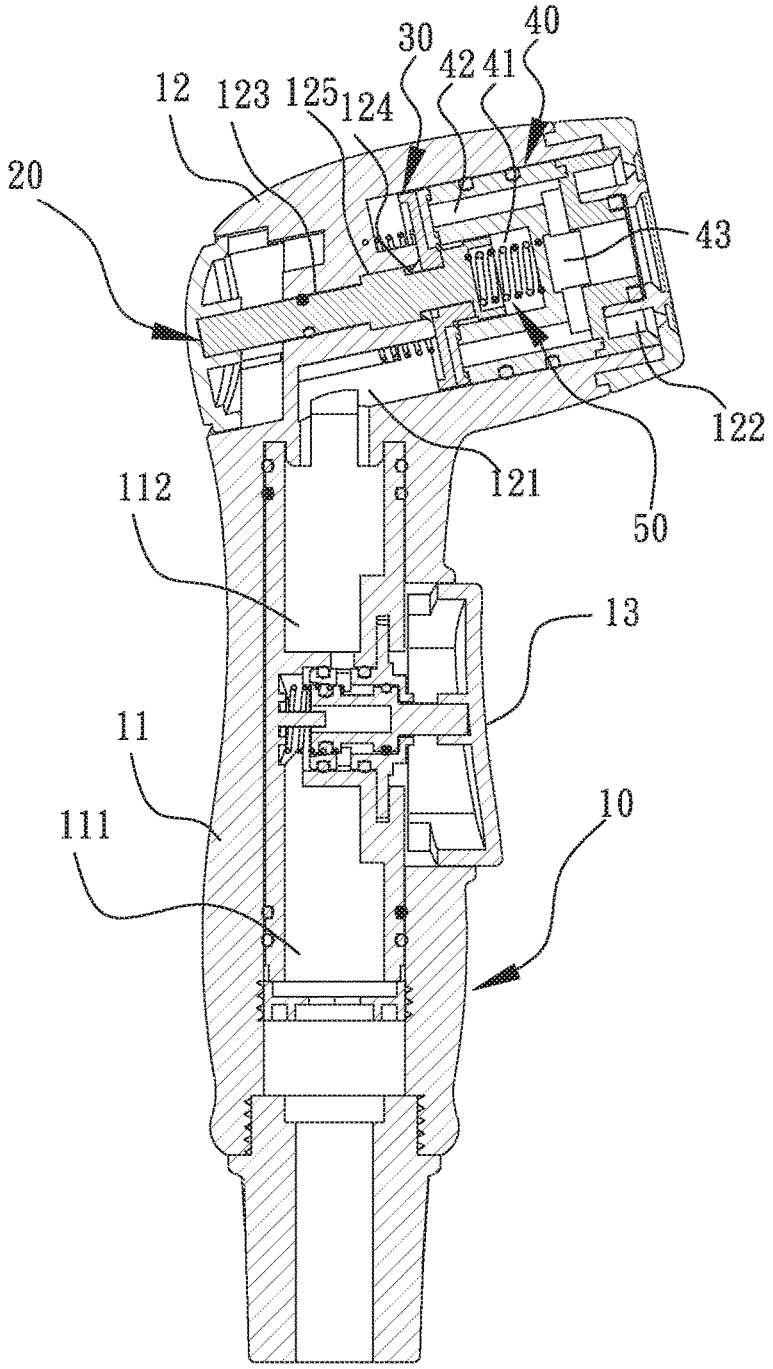
FIG. 2 is a sectional view of the preferred embodiment of the water spray nozzle of the present invention.
Figure 3:
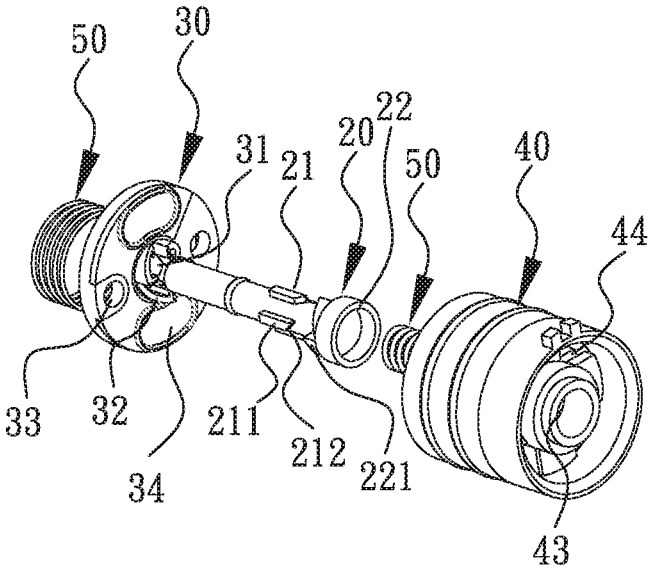
FIG. 3 is a perspective exploded view of a switching rod, a switching disk, a water passage switching piece and elastic support elements of the preferred embodiment of the water spray nozzle of the present invention.
Figure 4:
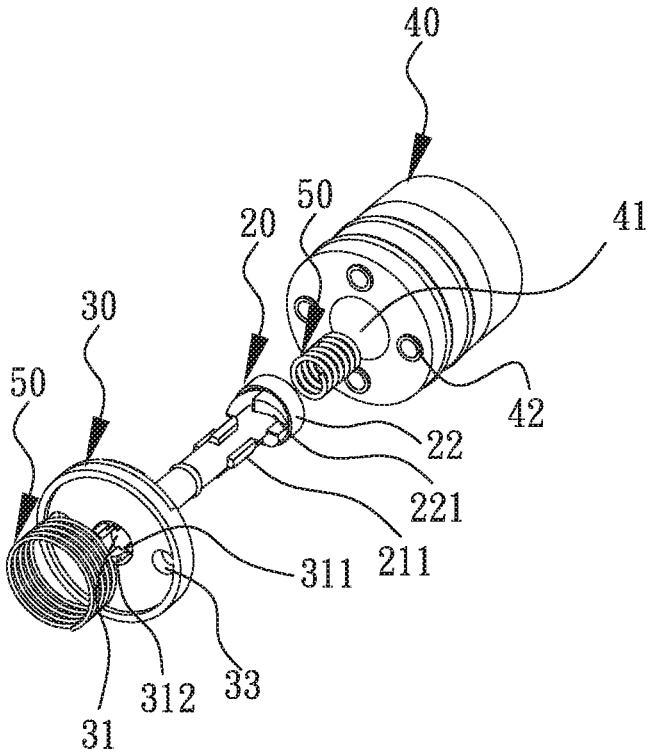
FIG. 4 is another perspective exploded view of the switching rod, the switching disk, the water passage switching piece and the elastic support elements of the preferred embodiment of the water spray nozzle of the present invention.

Please refer to FIGS. 1 to 4. FIGS. 1 to 4 are perspective view, sectional view and perspective exploded views of a preferred embodiment of a water spray nozzle of the present invention. The water spray nozzle comprises a handle body 10, a switching rod 20, a switching disk 20, a water passage switching piece 40 and two elastic support elements 50.

The handle body 10 has a handle portion 11 and a head portion 12. The handle portion 11 has a water inlet hole 111 and a water outlet hole 112. A switch valve 13 is disposed between the water inlet hole 111 and the water outlet hole 112. A water outlet compartment 121 is disposed in the head portion 12 for connecting with the water outlet hole 112. An opening 122 is disposed at an end of the water outlet compartment 121. An axial hole 123 is disposed at another end opposite to the opening 122. The axial hole 123 has a limitation groove 124 disposed inside the water outlet compartment 121. A preset quantity of limitation slots 125 is disposed axially and concavely inside the limitation groove 124.

The switching rod 20 is disposed inside the axial hole 123. A central of the switching rod 20 has a guiding piece 21 slidably disposed in the limitation groove 124. Guiding ribs 211 are disposed on a circumference of the guiding piece 21.

A slant guiding surface 212 is disposed at an end of the guiding rib 211. The guiding ribs 211 are axially limited inside the limitation slots 125. The switching rod 20 has a direction switching piece 22 disposed at the end of the water outlet compartment 121. A preset quantity of slant protruded portions 221 is disposed around the direction switching piece 22.

The switching disk 30 is disposed on a bottom of the water outlet compartment 121. A switching hole 31 is penetrated through a center of the switching disk 30. The switching disk 30 is disposed around the switching rod 20 between the guiding piece 21 and the direction switching piece 22. Switching ribs 311 are protrudedly disposed inside the switching hole 31. The switching rib 311 has a slant switching surface 312 disposed near the slant guiding surface 212. A preset quantity of slant switching protruded portions 32 is disposed outside the switching hole 31 near the direction switching piece 22 for meshing with the slant protruded portions 221. Two switching water holes 33 are disposed around a circumference of the switching disk 30. The switching water holes 33 are disposed roughly 180° apart. Two water stoppers 34 are disposed by the switching water holes 33 and on a side facing the opening 122.

The water passage switching piece 40 is concavely disposed with a recess 41 at a center. The recess 41 is provided for accommodating the direction switching piece 22 of the switching rod 20 and the slant switching surface 312 of the switching disk 30. Four water outlet holes 42 are disposed around a circumference of the water passage switching piece 40. The water passage switching piece 40 has two central passages 43 and two circular passages 44 disposed facing the opening 122. The central passages 43 and the circular passages 44 are respectively and alternatively connected to the water outlet holes 42. The water outlet holes 42 and the switching water holes 33 are disposed in a same radial direction so that the switching water holes 33 are selectively superimposed with the specific water outlet holes 42.

The two elastic support elements 50 are respectively disposed between the bottom of the water outlet compartment 121 and the switching disk 30, and between the direction switching piece 22 and the recess 41.

In order to further explain the structures and characteristics of the present invention, as well as the technical means and expected effects; the ways of usage are specifically described hereunder for in-depth understanding.

Please refer to FIGS. 1 to 4. When water is needed, simply press the switch valve 13 for connecting the water inlet hole 111 with the water outlet hole 112. Water is flowed from the water inlet hole 111 to the water outlet hole 112. Then the water is further flowed from the water outlet hole 112 to the water outlet compartment 121 of the head portion 12. Finally, the water is flowed to reach the opening 122.

For switching the water flowing direction, simply press the switching rod 20 so that the slant protruded portions 221 of the direction switching piece 22 will not limit the slant switching protruded portions 32, and the switching disk 30 can turn freely. Then, the slant guiding surfaces 212 of the guiding ribs 211 of the guiding piece 21 are connected with the slant switching surfaces 312 on top ends of the switching ribs 311 of the switching disk 30. The switching disk 30 turns at a certain degree. Meanwhile, the elastic support element 50 disposed between the recess 41 and the direction switching piece 22 generates an elastic force to cause the switching rod 20 to generate a resilient effect. When the switching rod 20 rebounds, because the switching disk 30 has already turned at a certain degree; the slant protruded portion 221 will mesh with the other slant switching protruded portion 32 to cause the switching disk 30 to turn at 90°. The change of the position of the switching disk 30 causes the switching water holes 33 to connect with the different water outlet holes 42. Water will flow out from the water outlet holes 42 which are connected with the switching water holes 33. The water will flow towards the central passages 43 or the circular passages 44. The water flowed towards the opening 122 is originated from the central passages 43 or the circular passages 44. The water is stopped by the water stoppers 34 for the water outlet holes 42 which are not connected with the switching water holes 33.

The switching rod 20 is used for switching between different ways of outlet of water. The switching rod 20 rebounds back to its original position after the switching is done. Simply press the switching rod 20 again for switching, and is not easily and mistakenly pressed to change direction of water flow. The switching is achieved simply by pressing the switching rod 20. Therefore, it is convenient and easy in usage. Furthermore, the ergonomic design of the switching rod 20 disposing in the head portion is convenient for users to press while holding the handle portion.

A water spray nozzle embodying aspects of the invention comprises a handle body with a water outlet compartment disposed in a head portion, an opening is disposed at an end of the water outlet compartment, and an axial hole is disposed at another end opposite to the opening; a switching rod disposed inside the axial hole, a central of the switching rod has a guiding piece with guiding ribs slidably disposed in a limitation groove, the switching rod has a direction switching piece disposed at the end of the water outlet compartment, and a preset quantity of slant protruded portions is disposed around the direction switching piece; a switching disk disposed on a bottom of the water outlet compartment, a switching hole is penetrated through a center of the switching disk, the switching disk is disposed around the switching rod between the guiding piece and the direction switching piece, switching ribs are protrudedly disposed inside the switching hole, the switching rib has a slant switching surface disposed near the guiding rib, a preset quantity of slant switching protruded portions is disposed outside the switching hole near the direction switching piece for meshing with the slant protruded portions, and a plurality of switching water holes is disposed around a circumference of the switching disk; a water passage switching piece with a preset quantity of water outlet holes disposed around a circumference, and the water outlet holes and the switching water holes are disposed in a same radial direction so that the switching water holes are selectively superimposed with the specific water outlet holes; and two elastic support elements respectively disposed between the bottom of the water outlet compartment and the switching disk, and between the direction switching piece and a recess.

Note that the specifications relating to the above embodiments should be construed as exemplary rather than as limitative of the present invention, with many variations and modifications being readily attainable by a person of average skill in the art without departing from the spirit or scope thereof as defined by the appended claims and their legal equivalents.

The Abstract and Summary are provided to help the reader quickly ascertain the nature of the technical disclosure. They are submitted with the understanding that they will not be used to interpret or limit the scope or meaning of the claims. The Summary is provided to introduce a selection of concepts in simplified form that are further described in the Detailed Description. The Summary is not intended to identify key features or essential features of the claimed subject matter, nor is it intended to be used as an aid in determining the claimed subject matter.

The order of execution or performance of the operations in embodiments of the aspects of the invention illustrated and described herein is not essential, unless otherwise specified. That is, the operations may be performed in any order, unless otherwise specified, and embodiments of the aspects of the invention may include additional or fewer operations than those disclosed herein. For example, it is contemplated that executing or performing a particular operation before, contemporaneously with, or after another operation is within the scope of aspects of the invention.

When introducing elements of aspects of the invention or the embodiments thereof, the articles "a," "an," "and/or," "the," and "said" are intended to mean that there are one or more of the elements. The terms "comprising," "including," and "having" are intended to be inclusive and mean that there may be additional elements other than the listed elements.

In view of the above, it will be seen that several advantages of the aspects of the invention are achieved and other advantageous results attained.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively or in addition, a component may be implemented by several components.

The above description illustrates the aspects of the invention by way of example and not by way of limitation. This description enables one skilled in the art to make and use the aspects of the invention, and describes several embodiments, adaptations, variations, alternatives and uses of the aspects of the invention, including what is presently believed to be the best mode of carrying out the aspects of the invention. Additionally, it is to be understood that the aspects of the invention is not limited in its application to the details of construction and the arrangement of components set forth in the following description or illustrated in the drawings. The aspects of the invention are capable of other embodiments and of being practiced or carried out in various ways. Also, it will be understood that the phraseology and terminology used herein is for the purpose of description and should not be regarded as limiting.

Having described aspects of the invention in detail, it will be apparent that modifications and variations are possible without departing from the scope of aspects of the invention as defined in the appended claims. It is contemplated that various changes could be made in the above constructions, products, and process without departing from the scope of aspects of the invention. In the preceding specification, various preferred embodiments have been described with reference to the accompanying drawings. It will, however, be evident that various modifications and changes may be made thereto, and additional embodiments may be implemented, without departing from the broader scope of the aspects of the invention as set forth in the claims that follow. The specification and drawings are accordingly to be regarded in an illustrative rather than restrictive sense.

What is claimed is:

1. A water spray nozzle, at least comprising:

a handle body with a handle portion and a head portion, the handle portion having a handle water inlet and a handle water outlet, a switch valve being disposed between the handle water inlet and the handle water outlet, a water outlet compartment being disposed in the head portion for connecting with the handle water outlet, an opening being disposed at an end of the water outlet compartment, an axial hole being disposed at another end opposite to the opening, the axial hole having a limitation groove disposed inside the water outlet compartment, and a preset quantity of limitation slots being disposed axially and concavely inside the limitation groove;

a switching rod disposed inside the axial hole, a central portion of the switching rod having a guiding piece slidably disposed in the limitation groove, guiding ribs being disposed on a circumference of the guiding piece, the guiding ribs being axially limited inside the limitation slots and each having a slant guiding surface disposed at an end thereof, the switching rod having a direction switching piece disposed at the end of the water outlet compartment, and a preset quantity of slant protruded portions being disposed around the direction switching piece;

a switching disk disposed on a bottom of the water outlet compartment, a switching hole being penetrated through a center of the switching disk, the switching disk being disposed around the switching rod between the guiding piece and the direction switching piece, switching ribs being protrudedly disposed inside the switching hole, the switching ribs each having a slant switching surface disposed near a respective one of the guiding ribs and opposite to the slant guiding surface disposed at the end thereof, a preset quantity of slant switching protruded portions being disposed outside the switching hole near the direction switching piece for meshing with the slant protruded portions, and a plurality of switching water holes being disposed around a circumference of the switching disk;

a water passage switching piece concavely disposed with a recess at a center of the water passage switching piece, the recess being provided for accommodating the direction switching piece of the switching rod and the slant switching surfaces of the switching disk, a preset quantity of water outlet holes being disposed around a circumference of the water passage switching piece, and the water outlet holes of the water passage switching piece and the switching water holes of the switching disk being disposed in a same radial direction so that each of the switching water holes is configured to be selectively superimposed upon at least one of the water outlet holes; and two elastic support elements respectively disposed between the bottom of the water outlet compartment and the switching disk, and between the direction switching piece and the recess.

2. The water spray nozzle as claimed in claim 1, wherein the switching disk has two switching water holes and the water passage switching piece has four water outlet holes, the switching water holes being disposed roughly 180° apart, and wherein the switching disk has two water stoppers each disposed opposite the other between the two switching water holes.

3. The water spray nozzle as claimed in claim 2, wherein the water passage switching piece has a plurality of passages including at least one central passage and at least one circular passage disposed facing the opening, wherein the switching disk is movable between a first position in which the switching water holes are connected to two of the water outlet holes via the at least one central passage and a second position in which the switching water holes are connected to the other two of the water outlet holes via the at least one circular passage.

* * * * *